United States Patent [19]

Nishimoto

[11] Patent Number: 4,893,539

[45] Date of Patent: Jan. 16, 1990

[54] CONTROL WAVEFORM GENERATING APPARATUS FOR AN ELECTRONIC MUSICAL INSTRUMENT

[75] Inventor: Tetsuo Nishimoto, Hamamatsu, Japan

[73] Assignee: Yamaha Corporation, Hamamatsu, Japan

[21] Appl. No.: 374,636

[22] Filed: Jun. 30, 1989

Related U.S. Application Data

[63] Continuation of Ser. No. 48,225, May 11, 1987, abandoned.

[30] Foreign Application Priority Data

May 13, 1986 [JP] Japan ..... 61-109063

[51] Int. Cl.[4] ..... G10H 1/057

[52] U.S. Cl. ..... 84/663; 84/665

[58] Field of Search ..... 84/1.13, 1.26, 477 R

[56] References Cited

U.S. PATENT DOCUMENTS

| | | | |
|---|---|---|---|
| 4,466,097 | 8/1984 | Nose | 84/1.13 X |
| 4,478,525 | 10/1984 | Yamaguchi | 84/1.13 X |
| 4,520,708 | 6/1985 | Wachi | 84/1.13 X |
| 4,532,849 | 8/1985 | Drew | 84/1.26 X |
| 4,538,495 | 9/1985 | Sato | 84/477 R X |
| 4,696,216 | 9/1987 | Asahi et al. | 84/1.13 |

FOREIGN PATENT DOCUMENTS 58-181091 10/1983 Japan .

*Primary Examiner*—Stanley J. Witkowski

*Attorney, Agent, or Firm*—Spensley Horn Jubas & Lubitz

[57] ABSTRACT

A control waveform generating apparatus for an electronic musical instrument generates a control waveform having at least a rising portion and a falling portion whose levels vary in a lapse of time. The control waveform is divided into a plurality of segment waveforms each of which includes a constant level portion (an interval portion) and at least one of the rising portion and the falling portion therein. The rising rates and falling rates and interval durations of the respective segment waveforms are selected by a player so that the control waveform having an arbitrary waveform can be obtained. When generating the control waveform, each of the plural segment waveforms is sequentially designated and outputted as a part of the entire control waveform. When the present segment waveform next to the preceding segment waveform is designated, the last level of the preceding segment waveform is maintained in a selected interval period. After this predetermined interval period is passed, the level of the present segment waveform increases or decreases according to a selected rising rate or falling rate.

11 Claims, 5 Drawing Sheets

| SEL | | PARAMETER SELECTION CKT 21 |
|---|---|---|
| OUT 1 | OUT 0 | |
| 0 | 0 | SEG 0 |
| 0 | 1 | SEG 1 |
| 1 | 0 | SEG 2 |
| 1 | 1 | SEG 3 |

CONTROL WAVEFORM GENERATING APPARATUS FOR AN ELECTRONIC MUSICAL INSTRUMENT

This is a continuation of copending application Ser. No. 048,225 filed on May 11, 1987 and now abandoned.

BACKGROUND OF THE INVENTION

1. Field of the Invention

The present invention generally relates to a control waveform generating apparatus for an electronic musical instrument, and more particularly to a control waveform generating apparatus in which a control waveform is generated for controlling a volume, a tone color and other characteristics of a musical tone to be varied with time.

2. Prior Art

As a conventional example of the control waveform generating apparatus for the electronic musical instrument, a known envelope waveform generating apparatus is designed to generate an envelope waveform which is rendered to be similar to that of an acoustic musical instrument as much as possible. An example of such envelope waveform generating apparatus has been disclosed in Japanese Patent Application Laid-Open No. 58-181091. This apparatus generates a typical envelope waveform signal ENV (shown in FIG. 9) having a so-called ADSR waveform which includes an attack portion A, a decay portion D, a sustain portion S and a release portion R therein.

Generally, the conventional envelope waveform generating apparatus is constituted so that an increment quantity or a decrement quantity is set for each variable portion such as the attack portion, the decay portion and the release portion and an adding operation is repeatedly performed by use of an increment quantity or a decrement quantity so as to obtain an envelope waveform of which waveform level varies with time. When a key in a keyboard is depressed to generate a key-on signal, the attack portion is immediately formed. When the waveform level of the attack portion has reached a predetermined level, the decay portion is formed, and then the waveform level of the decay portion reaches another predetermined level so that the sustain portion is started to be formed. Thereafter, when the depressed key is released, the release portion is started to be formed. These formations for the envelope waveform is performed sequentially.

In the actual use of the envelope generating apparatus, however, it is sometimes required to obtain a musical tone signal MS having an envelope waveform which rises at a time $t_1$ which is delayed by a predetermined delay time $T_D$ after a time $t_{ON}$ at which the key-on signal is generated as shown in FIG. 10, rather than an envelope waveform in which the attack portion thereof starts to rise at the time $t_{ON}$.

A conventional method for generating the above musical tone signal MS will be described in FIG. 11. According to this method, the delay time $T_D$ is computed in accordance with the following manner. First, a waveform portion A0 having an extremely small inclination is provided ahead of a waveform portion A1 which corresponds to the attack portion A shown in FIG. 9. This waveform portion A0 rises at the time $t_{ON}$ and the signal level thereof gradually increases to a signal level of $L_{IN}$ at the time $t_1$ when the musical tone is generated. The signal level of $L_{IN}$ is maintained to such a low level that any sensible musical tones are not generated in the delay time $T_D$.

The above method, however, is disadvantageous in that an additional and complicated processing step is newly required for setting the delay time $T_D$, so that the process for generating the envelope waveform becomes burdensome inevitably.

Particularly, the waveform shown in FIG. 10 encounters a difficulty in converting the time into the inclination of the waveform because the delay time $T_D$ is set in terms of the increment quantity which represents the inclination of the waveform portion A0.

Thus, though it may be said as possible to generate the envelope waveform similar to that of the acoustic musical instrument in the conventional envelope waveform generating apparatus, it is impossible to generate arbitrary envelope waveforms other than the envelope waveform of the acoustic musical instrument.

SUMMARY OF THE INVENTION

Accordingly, it is a primary object of the present invention to provide a control waveform generating apparatus for an electronic musical instrument in which the constitution thereof is simple and it is possible to generate desirable control waveforms (i.e., desirable envelope waveforms) according to the needs of the player.

According to an aspect of the invention, there is provided a control waveform generating apparatus for an electronic musical instrument, the control waveform generating apparatus generating a control waveform which comprises a plurality of segment waveforms divided along a time axis to constitute at least a rising portion and a falling portion therein and of which level varies with a lapse of time, the control waveform generating apparatus comprising: (a) segment designating means for sequentially designating a segment waveform among the plurality of segment waveforms in response to a command signal for generating a control waveform; (b) control waveform forming means for forming each designated segment waveform as a part of the control waveform thereby to form the entire control waveform; and (c) interval forming means coupled with the control waveform forming means for forming, in at least one selectable segment waveform, an interval portion of a selectable period in which the level of the control waveform is maintained at a selectable constant level.

BRIEF DESCRIPTION OF THE DRAWINGS

Further objects and advantages of the present invention will be apparent from the following description, reference being made to the accompanying drawings wherein preferred embodiments of the present invention are clearly shown.

In the drawings.

DESCRIPTION OF THE PREFERRED EMBODIMENT OF THE INVENTION

While the control waveform generating apparatus of the present invention may be used and applied to any apparatuses in which desirable control waveforms are used for controlling various characteristics of a musical tone, it will be specifically described in its application to an amplitude envelope waveform generating apparatus for the electronic musical instrument.

Figure 7:
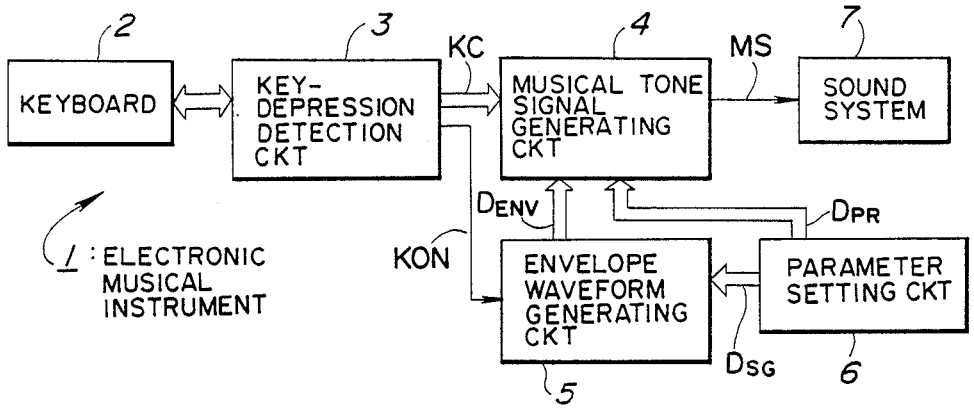
FIG. 7 is a block diagram showing a whole constitution of the electronic musical instrument.

Referring now to the drawings wherein like reference characters designate like or corresponding parts throughout several views. In FIG. 7, there is shown an electronic musical instrument 1 which has a keyboard 2 provided with a plurality of keys (not shown). When one of the keys is depressed, a key-depression detection circuit 3 supplies a key code signal KC corresponding to a depressed key to a musical tone signal generating circuit 4. The key-depression detection circuit 3 also supplies a key-on signal KON (see FIG. 1(B)) to an envelope waveform generating circuit 5. The logical level of the key-on signal KON is maintained to be "1" as long as the key is in the depressed condition.

The musical tone signal generating circuit 4 generates a musical tone MS in accordance with a parameter $D_{PR}$ including a tone color parameter which is set by the player through a parameter setting circuit 6. The tone pitch of the musical tone MS is determined in accordance with the key code signal KC corresponding to the depressed key.

The parameter setting circuit 6 also generates envelope waveform parameter data $D_{SG}$ in response to the operation by the player, and the envelope waveform parameter data $D_{SG}$ is supplied to an envelope waveform generating circuit 5 wherein an envelope waveform signal $D_{ENV}$ is generated based on the envelope waveform parameter data $D_{SG}$ and is supplied to the musical tone signal generating circuit 4.

Thus, the musical tone signal MS having a tone pitch, a tone color and an envelope waveform selected by the player is supplied to a sound system 7 wherein a musical tone is produced based on the musical tone signal MS.

In the present embodiment, the parameter setting circuit 6 includes a parameter setting operation panel 11 which includes an envelope waveform parameter setting portion 11A, a tone color selecting portion 11B and a portion 11C for setting other parameters therein.

Figures 1, 4:
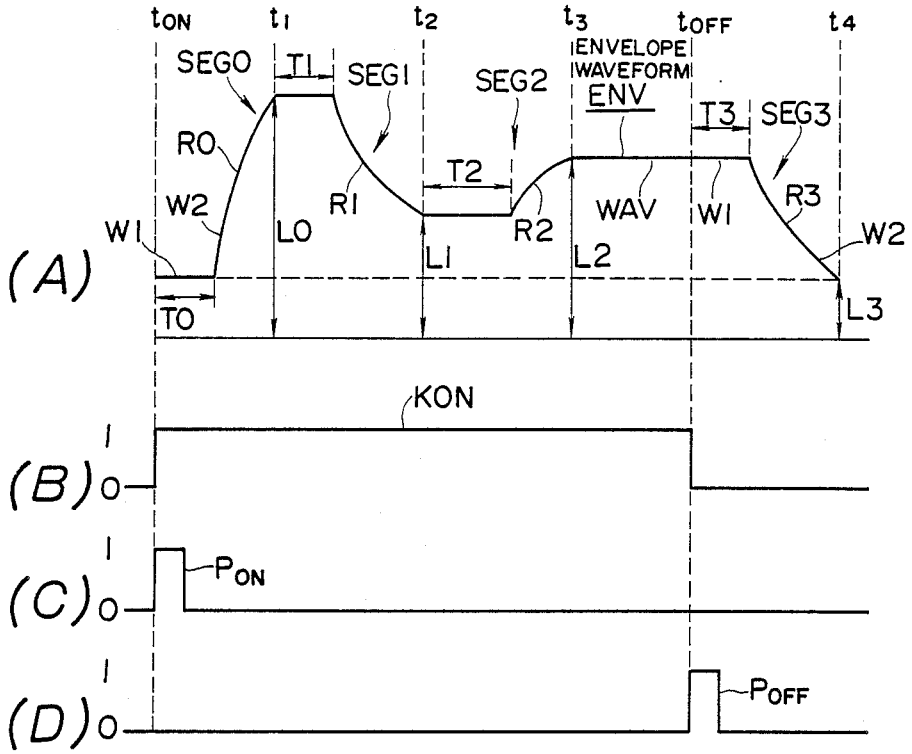
FIG. 1 shows an envelope waveform and other signal waveforms which are generated by a control waveform generating apparatus of the present invention.
FIG. 4 is a table for explaining the segment selection signal SEL.

As shown in FIG. 1 which will be described later, an envelope waveform ENV is constituted by four fundamental envelope waveform portions (hereinafter, these portions will be referred to as segments and a waveform in a segment will be referred to as a segment waveform). These four segment waveforms are successively generated and combined together so as to form the continuous envelope waveform ENV. Segments waveforms SEG0 to SEG3 are constituted by constant portions W1 of constant levels having durations T0 to T3 (hereinafter, the duration will be referred to as an interval) and rising or falling portions W2 in which waveform levels thereof change by predetermined inclinations R0 to R3 (hereinafter, the inclination will be referred to as a rate). The waveform levels of the rising or falling portions W2 rises or falls to desirable waveform levels L0 to L3 from the portions W1.

Thus, the respective segment waveforms SEG0 to SEG3 constituting the envelope waveform ENV are defined by forming the constant portions W1 determined by the intervals T0 to T3, and then forming the rising or falling portions W2 which rise or fall to desirable waveform levels L0 to L3 by inclinations corresponding to the rates R0 to R3.

The envelope waveform generating circuit 5 generates the segment waveforms SEG0 to SEG3 so that the segment waveforms SEG0 to SEG3 can be successively connected in series. More specifically, the segment waveform SEG0 is generated when the key-on signal is generated at a time $t_{ON}$. Thus, the waveform level of the envelope waveform ENV is maintained at a constant level throughout the interval T0, and then the envelope waveform ENV rises by the rate R0 to reach the desirable waveform level L0 at a time $t_1$ when the interval T1 of the next segment waveform SEG1 is started. Similarly, after the interval T1 is passed away, the waveform level of the envelope waveform ENV falls by the rate R1 to reach the desirable level L1 at a time $t_2$ when the interval T2 of the next segment waveform SEG2 is started. After the interval T2 is passed away, the waveform level of the envelope waveform ENV rises by the rate R2 to reach the desirable waveform level L2 at the time $t_3$. This desirable waveform level L2 is maintained till a time $t_{OFF}$ when the logical level of the key-on signal KON falls to "0". Thereafter, when the logical level of the key-on signal becomes "0" at the time $t_{OFF}$, the waveform level of the envelope waveform ENV is first maintained in the interval T3 and then falls by the rate R3 to reach the desirable waveform level L3 at a time $t_4$.

Figure 8:
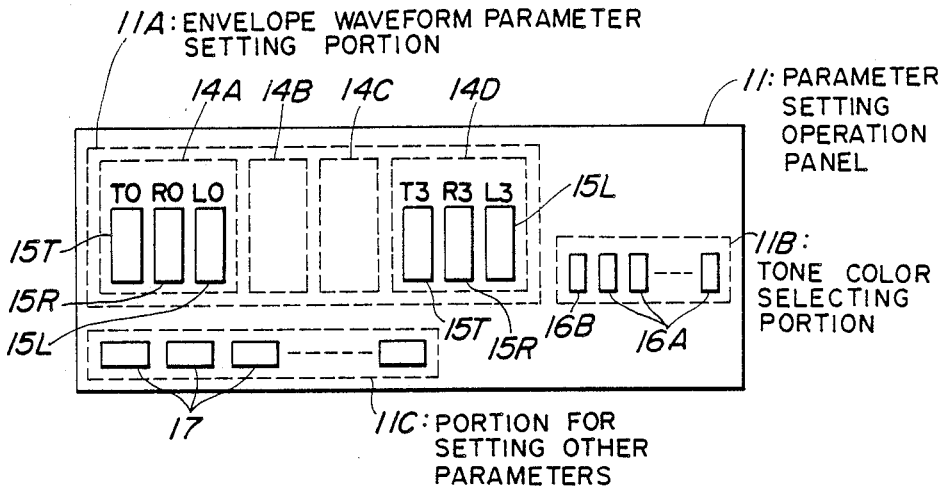
FIG. 8 is a diagrammatic illustration showing a detailed constitution of a parameter setting operation panel associated with a parameter setting circuit 6 shown in FIG. 7.

The envelope waveform ENV is defined by the intervals T0 to T3, the rates R0 to R3 and desirable waveform levels L0 to L3 all of which are selected by the player through the envelope waveform parameter setting portion 11A. The envelope waveform parameter setting portion 11A has switch groups 14A, 14B, 14C and 14D (shown in FIG. 8) corresponding to the respective segment waveforms SEG0, SEG1, SEG2 and SEG3. Each switch group has an interval setting switch 15T, a rate setting switch 15R and a level setting switch 15L therein. In the present embodiment, each of the switches 15T, 15R and 15L is constituted by a multistage switch so that the player can select suitable periods of the intervals T0 to T3, values of the rates R0 to R3 and the values of the desirable waveform levels L0 to L3.

The tone color selecting portion 11B is constituted by a selection switches 16A by which the player can select one tone color among tone colors which are preset in a factory and another selection switch 16B by which the player can select one tone color among other tone colors which are set by the player himself.

The portion 11C for setting other parameters is constituted by a plurality of parameter setting switches 17 by which the player can set various parameters such as parameters concerning a vibrato effect and the like and parameters concerning a total tone volume, for example.

Figure 2:
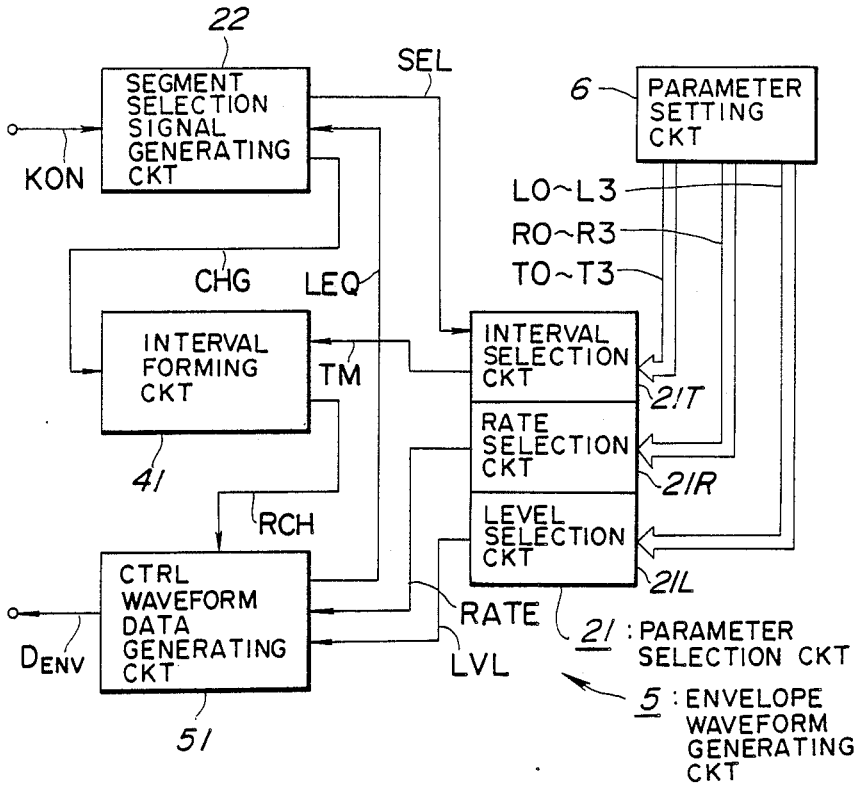
FIG. 2 is a block diagram of an envelope waveform generating circuit which is an embodiment of the present invention.

In FIG. 2, the envelope waveform parameter data $D_{SG}$ outputted from the parameter setting circuit 6, i.e., data concerning the intervals T0 to T3, data concerning the rates R0 to R3 and data concerning the desirable waveform levels L0 to L3, are respectively supplied to an interval selection circuit 21T, a rate selection circuit 21R and a level selection circuit 21L within a parameter selection circuit 21. Each of the selection circuits 21T, 21R and 21L are controlled in such a manner that one of data groups concerning the segment waveforms SEG0 TO SEG3 is selected in accordance with the segment selection signals SEL outputted from a segment selection signal generating circuit 22. The interval selection circuit 21T, the rate selection circuit 21R and the level selection circuit 21L successively output data groups (T0, R0, L0), (T1, R1, L1), . . . , (T3, R3, L3) for forming segment waveforms SEG0, SEG1, . . . , SEG3, as data groups comprised of interval designating data TM, rate designating data RATE and level designating data LVL.

Figure 3:
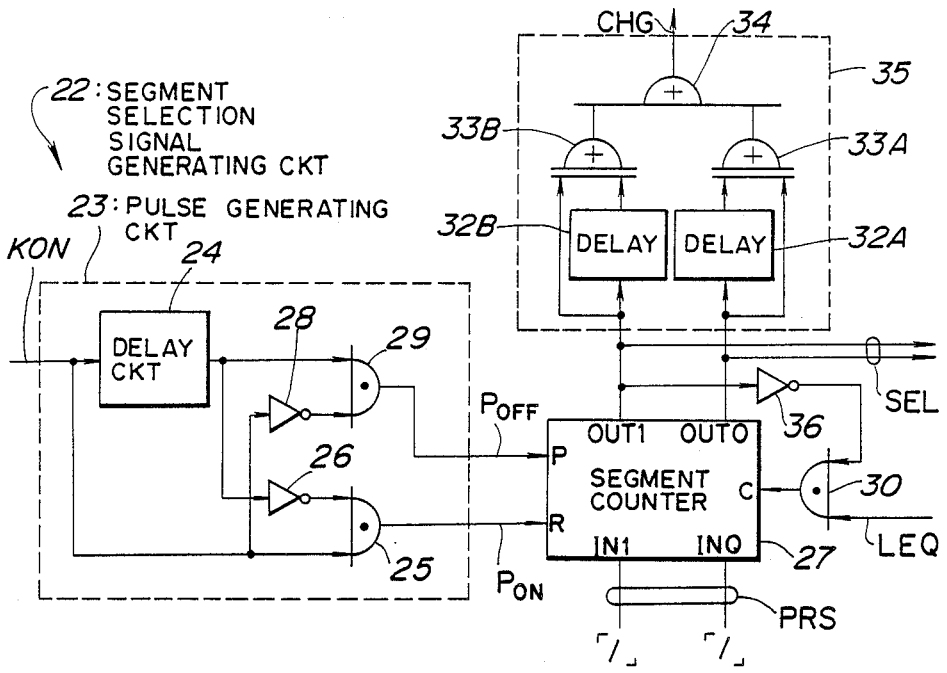
FIG. 3 is a block diagram showing a detailed constitution of a segment selection signal generating circuit 22 shown in FIG. 2.

As shown in FIG. 3, the segment selection signal generating circuit 22 has a pulse generating circuit 23 which receives the key-on signal KON (shown in FIG. 1(B)) from the key-depression detection circuit 3. Upon receipt of the key-on signal, the segment selection signal generating circuit 22 generates a segment selection signal SEL which designates the segment waveforms SEG0 TO SEG3 sequentially. The key-on signal KON is supplied to a first input terminal of an AND circuit 25 within the pulse generating circuit 23. On the other hand, the key-on signal KON is delayed in a delay circuit 24. The delayed key-on signal KON is inverted in an inverter 26 and inverted key-on signal KON is supplied to a second input terminal of the AND circuit 25. Thus, as shown in FIG. 1(C), the AND circuit 25 outputs a key-on pulse $P_{ON}$ to a reset terminal R of a segment counter 27 at the time $t_{ON}$ when the key-on signal KON is generated.

In addition, the key-on signal KON is also supplied to a first input terminal of an AND circuit 29 via and inverter 28, and the delayed key-on signal KON from the delay circuit 24 is also supplied to a second input terminal of the AND circuit 29. Thus, as shown in FIG. 1(D), the AND circuit 29 outputs a key-off pulse $P_{OFF}$ to a preset input terminal P of the segment counter 27 at the time $t_{OFF}$ when the key-on signal KON falls.

The segment counter 27 is constituted by a preset counter having input terminals IN0 and IN1 for preset data each of which is supplied with preset input data PRS having a logical level of "1". When a key-off pulse $P_{OFF}$ is given to the preset input terminal P, the segment counter 27 is preset to a state in which it outputs a count signal having a logical level "1" via count output terminals OUT1 and OUT0, so that the segment counter 27 outputs a segment selection signal SEL for selecting the segment waveform SEG3 as shown in FIG. 4. On the other hand, when the key-on pulse $P_{ON}$ is inputted to the reset terminal R so as to reset the segment counter 27, the segment counter 27 is set to a state in which it outputs a count signal having a logical level "0" via the count output terminals OUT0 and OUT1, so that the segment counter 27 outputs the segment selection signal SEL for selecting the segment waveform SEG0.

A level coincidence detection signal LEQ is inputted into a count input terminal C of the segment counter 27 via an AND circuit 30. When the level of the level coincidence detection signal LEQ becomes "1", the segment counter 27 starts its counting operation. In this case, when the segment counter 27 starts its counting operation in its reset state, the state of the segment counter 27 is changed to a state in which it outputs the segment selection signal SEL for selecting the segment waveform SEG1 by outputting count signals having logical levels "1" and "0" to its count output terminals OUT1 and OUT0 respectively. In addition, when the level coincidence detection signal LEQ is supplied to the segment counter 27 again in this state, the segment counter 27 performs the counting operation again so as to output the count signals having logical levels "1" and "0" to the respective count output terminals OUT1 and OUT0, so that the segment counter 27 outputs the segment selection signal SEL for selecting the segment waveform SEG2.

In addition, the segment selection signal SEL of 2 bits is also supplied to a pulse generating circuit 35 which is constituted by delay circuits 32A and 32B, EXCLUSIVE OR circuits 33A and 33B and an OR circuit 34. At this time, when the logical level of each bit of the segment selection signal SEL rises from "0" to "1" or falls from "1" to "0", the pulse generating circuit 35 generates a segment change-over detection signal CHG each pulse of which has a pulse width corresponding to delay times of the delay circuits 32A an 32B. This segment change-over detection signal CHG is outputted to an interval forming circuit 41.

Furthermore, the segment selection signal generating circuit 22 feeds back an upper bit of the count signal from the count output terminal OUT1 of the segment counter 27 to the AND circuit 30 via an inverter 36 as an input prohibition signal of one bit. In consequence, when the above upper bit of the count signal rises to the logical level "1" (this means that the segment selection signal SEL is changed so as to select the segment waveform SEG2), the operation of the AND circuit 30 is prohibited so as to prevent the level coincidence detection signal LEQ from being inputted into the count input terminal C of the segment counter 27. As a result, when the envelope level of the segment waveform SEG2 reaches the level L2 at the time $t_3$ shown in FIG. 1 so as to complete the rising operation at the inclination selected by the rate R2, the level L2 of the segment waveform SEG2 is maintained until the time $t_{OFF}$ when the key-off pulse $P_{OFF}$ is generated.

Figure 5:
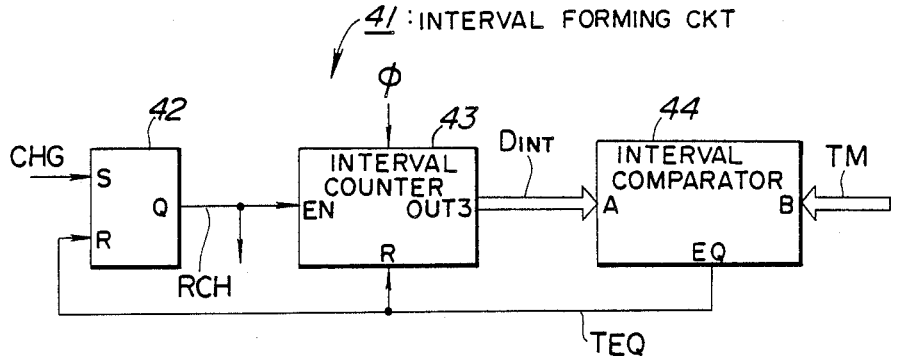
FIG. 5 is a block diagram showing a detailed constitution of an interval forming circuit 41 shown in FIG. 2.

As shown in FIG. 5, the segment change-over detection signal CHG is supplied to a set input terminal S of a latch circuit 42 constituted by a RS flip-flop within the interval forming circuit 41. The segment change-over detection signal CHG having the logical level "1" is latched in the latch circuit 42. A latch signal RCH is outputted from a output terminal Q of the latch circuit 42 to an enable input terminal EN of an interval counter 43 as an enable signal EN. In consequence, the interval counter 43 starts to perform the counting operation in accordance with a clock $\phi$ and generates interval count data $D_{INT}$ at a count output terminal OUT3. This interval count data $D_{INT}$ is supplied to a comparison input terminal A of an interval comparator 44.

The parameter selection circuit 21 (shown in FIG. 2) outputs interval designating data TM to an comparison input terminal B of the interval comparator 44. When the value of the interval count data $D_{INT}$ coincides with that of the interval designating data TM, the interval comparator 44 outputs an interval coincidence detection signal TEQ from a coincidence detection output terminal EQ to reset input terminals R of the latch circuit 42 and the interval counter 43 as reset signals.

In the interval forming circuit 41 shown in FIG. 5, the interval counter 43 starts the counting operation in response to a latching operation of the latch circuit 42 which is triggered by the segment change-over detection signal CHG supplied from the segment selection signal generating circuit 22. When the value of the interval count data $D_{INT}$ coincides with that of the interval designating data TM which have been selected by the parameter selection circuit 21 with respect to the present segment waveform, the interval comparator 44 outputs the interval coincidence detection signal TEQ so as to reset the latch circuit 42 and the interval counter 43 as well. Hence, the latch signal RCH having the logical level "1" can be obtained in a period corresponding to the interval designating data TM after the segment change-over detection signal CHG is generated.

The latch signal RCH from the latch circuit 42 is outputted to a control waveform data generating circuit 51 (shown in FIG. 6) as an operation prohibition signal.

Figure 6:
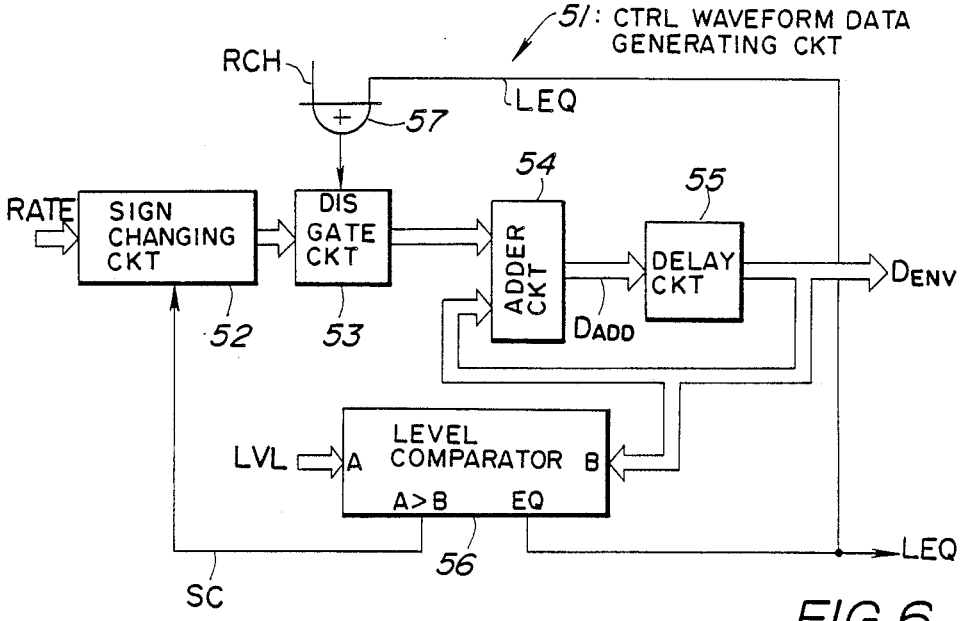
FIG. 6 is a block diagram showing a detailed constitution of a control waveform data generating circuit 51 shown in FIG. 2.

In the control waveform data generating circuit 51 shown in FIG. 6, the rate designating data RATE corresponding to each segment waveform is successively outputted from the parameter selection circuit 21, and the rate designating data RATE is passed through a sign changing circuit 52 and a gate circuit 53 in series and is supplied to one input terminal of an adder 54. Addition output data $D_{ADD}$ outputted from the adder 54 is delayed by a predetermined delay time in a delay circuit 55, and the delayed data $D_{ADD}$ is fed back to another input terminal of the adder 54 and is outputted as envelope waveform data $D_{ENV}$ which represent the present waveform level of the control waveform (i.e., the envelope waveform ENV).

The rate designating data RATE is repeatedly added to the envelope waveform data $D_{ENV}$ by every cycle of the delay time of the delay circuit 55 so as to obtain the addition output data $D_{ADD}$. Hence, the level of the envelope waveform data $D_{ENV}$ is increased or decreased by a inclination corresponding to the rate designating data RATE.

The envelope waveform data $D_{ENV}$ is supplied to an input terminal B of a level comparator 56 wherein the value of the envelope waveform data $D_{ENV}$ is compared with that of the level designating data LVL supplied at another input terminal A of the level comparator 56. When the value of the level designating data LVL is larger than that of the envelope waveform data $D_{ENV}$, the level comparator 56 outputs a sign changing signal SC having the logical level "1" to the sign changing circuit 52.

The sign changing signal SC is a signal for controlling the rising portion or the falling portion of the envelope waveform ENV. When the level designated by the level designating data LVL from the parameter selection circuit 21 is larger than the present level of the envelope waveform ENV shown in FIG. 1(A) (i.e., the level of the envelope waveform data $D_{ENV}$), a sign "+" is attached to the rate designating data RATE in order to raise the level of the envelope waveform ENV. This positive rate designating data RATE is inputted into the adder 54 via the gate circuit 53, so that the value of the addition output data $D_{ADD}$ (i.e., the value of the envelope waveform data $D_{ENV}$) is increased.

On the other hand, when the level designated by the level designating data LVL from the parameter selection circuit 21 smaller than the level of the envelope waveform data $D_{ENV}$, a sign "−" is attached to the rate designating data RATE in the sign changing circuit 52 by the sign changing signal SC in order to decrease the level of the envelope waveform ENV. This negative rate designating data RATE is inputted into the adder 54 via the gate circuit 53, so that the value of the envelope waveform data $D_{ENV}$ is decreased.

When the value of the level designating data LVL coincides with that of the envelope waveform data $D_{ENV}$, the level comparator 56 generates the level coincidence detection signal LEQ having the logical level "1". This level coincidence detection signal LEQ is passed through an OR circuit 57 and is supplied to a closing control terminal DIS of the gate circuit 53, so that the gate circuit 53 is closed. At this time, the rate appointing data RATE is prohibited from being inputted into the adder 54, so that the addition operation of the adder 54 is prohibited.

In addition, the latch signal RCH from the interval forming circuit 41 (shown in FIG. 5) is also supplied to the gate circuit 53 via the OR circuit 57 as an operation prohibition signal, whereby the gate circuit 53 prohibits the rate designating data RATE from being inputted into the adder 54 in a period when the interval forming circuit 41 forms the intervals T0 to T3. Hence, the value of the envelope waveform data $D_{ENV}$ is maintained at a constant value.

The level coincidence detection signal LEQ from the level comparator 56 within the control waveform data generating circuit 51 is supplied to the count input terminal C of the segment counter 27 via the AND circuit 30 within the segment selection signal generating circuit 22 (shown in FIG. 3). At this time, the segment counter 27 starts to perform the counting operation so as to designate a new segment waveform in accordance with the segment selection signal SEL.

The above is the constitution of the present embodiment of the invention. Next, description will be given with respect to the action (or the operation) of the present embodiment.

When the player depressed a key on the keyboard 2, the logical level of the key-on signal KON becomes "1" and the pulse generating circuit 23 within the segment selection signal generating circuit 22 (shown in FIG. 3) generates the key-on pulse $P_{ON}$, so that the segment counter 27 is reset. At this time, the logical levels of the count output terminals OUT1 and OUT0 become "00" so that the segment selection signal SEL designates the segment waveform SEG0 as shown in FIG. 4.

At this time, the parameter selection circuit 21 (shown in FIG. 2) outputs the interval data T0, the rate data R0 and the level data L0 as the interval designating data TM, the rate designating data RATE and the level designating data LVL respectively.

Meanwhile, the segment selection signal generating circuit 22 (shown in FIG. 3) outputs the segment change-over detection signal CHG based on the change of the segment selection signal SEL. The segment change-over detection signal CHG is supplied to the interval forming circuit 41 (shown in FIG. 5) wherein the latch circuit 42 starts to perform the latch operation. In this case, when the logical level of the latch signal RCH becomes "1", the interval counter 43 starts to perform the counting operation. At the same time, the latch signal RCH having the logical level "1" is supplied to the gate circuit 53 within the control waveform data generating circuit 51 (shown in FIG. 6) as the operation prohibition signal. As a result, the value of the envelope waveform data $D_{ENV}$ is maintained at the constant value.

Actually, in the preceding envelope waveform formation, the level of the addition output data $D_{ADD}$ is maintained at the level L3. Hence, the level of the envelope waveform data $D_{ENV}$ is still maintained at the level L3 when the present envelope waveform formation is started at the time $t_{ON}$.

Thereafter, the interval comparator 44 within the interval forming circuit 41 (shown in FIG. 5) generates the interval coincidence detection signal TEQ, whereby the latch circuit 42 is reset and the logical level of the latch signal RCH becomes "0" so as to open the gate circuit 53 within the control waveform data generating circuit 51 shown in FIG. 6. Hence, the rate designating data RATE obtained at the output terminal of the sign changing circuit 52 is inputted into the adder 54 via the gate circuit 53.

Meanwhile, as shown in FIG. 1 (A), when the segment selection signal SEL designates the segment waveform SEG0, the level of the level designating data LVL outputted from the level selection circuit 21L (shown in FIG. 2) is set to the level L0 which is higher than the level L3 of the present envelope waveform data $D_{ENV}$. Hence, the level comparator 56 outputs a sign changing signal SC having the logical level "1" to the sign changing circuit 52 wherein increment data "+R0" is obtained at the output terminal thereof as the rate designating data RATE. In consequence, the adder 54 repeatedly adds the increment data "+R0" to the envelope waveform data $D_{ENV}$, whereby the control waveform data generating circuit 51 outputs the envelope waveform data $D_{ENV}$ of which value is increased as time elapses.

Thereafter, the logical level of the level coincidence detection signal LEQ from the level comparator 56 becomes "1" at the time $t_1$ shown in FIG. 1(A), and the signal LEQ having the logical level "1" is passed through the OR circuit 57 and is supplied to the gate circuit 53 to thereby close the gate circuit 53. In consequence, the adder 54 stops to perform the operation for repeatedly accumulating the increment data "+R0" after the time $t_1$, and the adder 54 continues to output the envelope waveform data $D_{ENV}$ indicating the level L0 at the time $t_1$.

At the same time, the level coincidence detection signal LEQ having the logical level "1" is passed through the AND circuit 30 (shown in FIG. 3) and is supplied to the segment counter 27 wherein the counting operation is started and the value of the segment selection is changed to "01" (see FIG. 4).

Thus, the envelope waveform generating circuit 5 generates the segment waveform SEG1 (shown in FIG. 1(A)). As a result, the parameter selection circuit 21 outputs the data group for the interval T1, the rate R1 and the level L1 as the data group including the interval designating data TM, the rate designating data RATE and the level designating data LVL therein.

In this case, the interval data T1 is supplied to the interval comparator 44 within the interval forming circuit 41 (shown in FIG. 5) as the interval designating data TM, the rate data R1 is supplied to the sign changing circuit 52 within the control waveform data generating circuit 51 (shown in FIG. 6) as the rate designating data RATE, and the level data L1 is supplied to the level comparator 56 as the level designating data LVL.

As will be obvious from FIG. 1(A), the value of the level L1 selected at the time $t_1$ is smaller than the present value of the envelope waveform data $D_{ENV}$ (indicating the level L0 of the preceding segment waveform SEG0). Hence, the logical level of the sign changing signal SC is lowered to "0" so that the sign change-over circuit 52 outputs negative decrement data "−R1". In this case, however, the gate circuit 53 is closed by the latch signal RCH. More specifically, in the segment selection signal generating circuit 22 (shown in FIG. 3), the segment change-over detection signal CHG is generated from the pulse generating circuit 35 by the counting operation of the segment counter 27, whereby the latch circuit 42 (shown in FIG. 5) re-starts to perform the latch operation so as to raise the logical level of the latch signal RCH to "1". Hence, the gate circuit 53 within the control waveform data generating circuit 51 is closed by the latch signal RCH having the logical level "1".

At the same time, the interval counter 43 starts to perform the counting operation by the latch signal RCH having the logical level "1", and thereby the interval forming circuit 41 starts to perform the formation for the interval T1 in the segment waveform SEG1.

Thereafter, the interval indicated by the interval count data $D_{INT}$ from the interval counter 43 coincides with the interval T1 indicated by the interval designating data TM so as to obtain the interval coincidence detection signal TEQ. As described before in the description with respect to the segment waveform SEG0, the latch circuit 42 is reset by the interval coincidence detection signal TEQ so that the gate circuit 53 within the control waveform data generating circuit 51 (shown in FIG. 6) is opened and the decrement data "−R1" obtained at the output terminal of the sign changing circuit 52 is inputted into the adder 54 via the opened gate circuit 53. Therefore, in the adder 54, the value of the decrement data "−R1" is repeatedly subtracted from the present value of the envelope waveform data $D_{ENV}$, whereby the waveform level of the envelope waveform data $D_{ENV}$ is gradually lowered.

Thereafter, the level of the envelope waveform data $D_{ENV}$ becomes equal to the level L1 of the level designating data LVL at the time $t_2$ shown in FIG. 1, so that the gate circuit 53 is closed again by the level coincidence detection signal LEQ and the segment counter 27 within the segment selection signal generating circuit 22 (shown in FIG. 3) starts to perform the counting operation.

As a result, the segment selection signal SEL designates the segment waveform SEG2 and the parameter selection circuit 21 (shown in FIG. 2) selects data group including the interval data T2, the rate data R2 and the level data L2 concerning the segment waveform SEG2. Then, the interval T2 is formed by the interval forming circuit 41 (shown in FIG. 5) in the same manner as that explained before with respect to the segment waveform SEG0. Thereafter, the control waveform data generating circuit 51 (shown in FIG. 6) repeatedly adds increment data "+R2" obtained at the output terminal of the sign changing circuit 52, whereby the rising portion of the segment waveform SEG2 is formed.

Thereafter, the level of the envelope waveform data $D_{ENV}$ coincides with the level L2 at the time $t_3$ so that the gate circuit 53 is closed by the level coincidence detection signal LEQ. This level coincidence detection signal LEQ is supplied to one input terminal of the AND circuit 30 within the segment selection signal generating circuit 22 (shown in FIG. 3). In addition, when the segment counter 27 starts to perform the counting operation and the segment selection signal SEL becomes "10", inverted upper bit signal of the segment selection signal SEL having the logical level "0" is inputted to another input terminal of the AND circuit 30 via the inverter 36. Hence, the segment counter 27 is prohibited from performing the counting operation by the level coincidence detection signal LEQ. As a result, the pulse generating circuit 35 within the segment selection signal generating circuit 22 does not output the segment change-over detection signal CGH at the time $t_3$ so that the latch circuit 42 within the interval forming circuit 41 (shown in FIG. 5) does not work. Therefore, the state of the interval forming circuit 41 is changed into a wait state for not starting to perform the interval formation and for waiting until the new segment change-over detection signal CHG is generated. And the control waveform data generating circuit 51 (shown in FIG. 6) continues to output the envelope waveform data $D_{ENV}$ which maintains the level L2 at the time $t_3$, as will be understood from FIG. 1(A).

When the player releases the key on the keyboard 2 at the time $t_{OFF}$ shown in FIG. 1(A), the key-off pulse $P_{OFF}$ is generated by the pulse generating circuit 23 within the segment selection signal generating circuit 22 (shown in FIG. 3) as shown in FIG. 1(D). The segment counter 27 is preset by the key-off pulse, and thereby the value of the segment selection signal SEL is changed into "11" (see FIG. 4). This segment selection signal SEL designates the segment waveform SEG3 and renders the pulse generating circuit 53 (shown in FIG. 3) to output the segment change-over detection signal CHG.

In this state, data representing the interval T3 is supplied to the interval forming circuit 41 (shown in FIG. 5) and the latch circuit 42 is set by the segment change-over detection signal CHG. The latch signal RCH having the logical level "1" from the latch circuit 42 serves to prevent the gate circuit 53 within the control waveform data generating circuit 51 (shown in FIG. 6) from being opened, whereby the adder 54 is prevented from performing an accumulation operation. Therefore, the present level of the envelope waveform data $D_{ENV}$ is maintained even though the level designating data LVL is changed to the level data L3 of which level is lower than that of the present value of the envelope waveform data $D_{ENV}$.

Thus, the interval forming circuit 41 starts to perform the formation of the interval T3. When the value of the interval count data $D_{INT}$ from the interval counter 43 becomes equal to that of the interval designating data TM which represents the interval T3, the latch circuit 42 is reset by the interval coincidence signal TEQ. As a result, the gate circuit 53 is opened by the latch signal RCH so that decrement data "−R3" is obtained at the output terminal of the sign changing circuit 52 and is repeatedly added to the envelope waveform data $D_{ENV}$ in the adder 54, whereby the level of the envelope waveform data $D_{ENV}$ is gradually lowered.

At the time $t_4$, the value of the envelope waveform data $D_{ENV}$ reaches the value given by the level data L3 which is inputted into the level comparator 56 as the level designating data LVL. In this state, the level comparator 56 outputs the level coincidence detection signal LEQ which serves to close the gate circuit 53, and then the formation for a continuous envelope waveform data $D_{ENV}$ is completed.

As will be understood from the foregoing description, in the illustrated embodiment of the present invention, the envelope waveform generating circuit 5 forms so-called attack portion of the envelope waveform by use of the segment waveform SEG0 and also forms a waveform corresponding to so-called decay portion by use of the segment waveform SEG1. The envelope waveform generating circuit 5 further forms a waveform corresponding to so-called sustain portion of the envelope waveform by use of the segment waveform SEG2 and its sequential portion WAV having the constant level (which is formed in a period between the time $t_3$ and the time $t_{OFF}$). In addition, when the key-off signal is generated during the period of the sustain portion, the envelope waveform generating circuit 5 forms so-called release portion of the envelope waveform by use of the segment waveform SEG3.

In the present embodiment, each of the segment waveforms SEG0 to SEG3 has the interval portion having the constant level and rising or falling portion in which the waveform level is changed by the predetermined inclination. These segment waveforms SEG0 to SEG3 are successively formed and thereby the desirable envelope waveform ENV can be formed. In addition, it is possible to select and designate the interval data group T0 to T3 for determining the duration of the constant waveform portion, the rate data group R0 to R3 for determining the inclinations of the rising portion or the falling portion, and the level data group L0 to L3 for determining end levels of the rising portion or the falling portion. Furthermore, the present embodiment employs a simple constitution in which a common waveform forming circuit is repeatedly operated so as to form every segment waveform, hence, it is possible to form the attack portion, the decay portion, the sustain portion and the release portion with ease.

Figure 10:
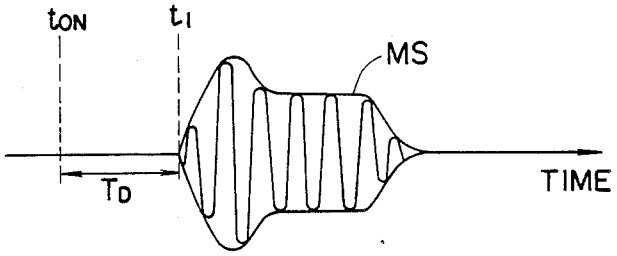
FIG. 10 shows a desirable signal waveform of the musical tone signal.
Figure 11:
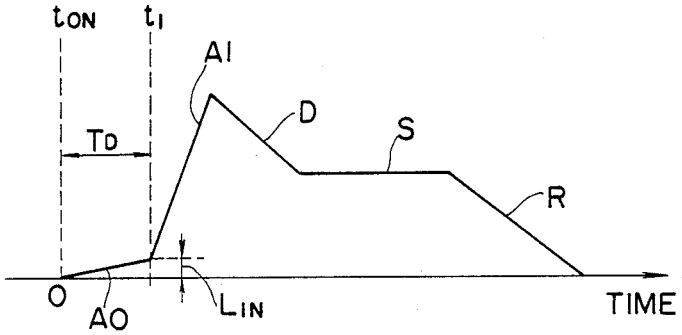
FIG.11 (PRIOR ART)
FIG. 11 shows an envelope waveform which is generated by the conventional envelope waveform generating apparatus.

It is possible for the player to arbitrarily designate the interval T0 to T3, the rate R0 to R3 and the level L0 to L3 according to needs. Hence, as described before in conjunction with FIGS. 10 and 11, the value of the interval data T0 can be selected to an optimum value, whereby it is possible to select an optimum period between the key-on time and the musical tone generating time with ease.

In addition, the constant waveform portion W1 follows after the rising or falling waveform portion W2 in the present embodiment. Hence, it is possible for the player to form musical tones having other envelope waveforms than the envelope waveform of the acoustic musical instrument according to needs. As a result, it is possible to realize an electronic musical instrument for generating original musical tones with ease.

BRIEF DESCRIPTION OF OTHER MODIFIED EMBODIMENTS

Next, description will be given with respect to modified embodiments other than the above preferred embodiment.

(1) The former embodiment is applied to a monophonic electronic musical instrument. However, it is possible to apply the present invention to a polyphonic electronic musical instrument in which a plurality of musical tones are simultaneously generated by use of a time division system.

(2) The former embodiment has not described about the detailed constitution of the musical tone signal generating circuit 4 (shown in FIG. 7). However, as the envelope waveform data $D_{ENV}$ is multiplied in the musical tone signal generating circuit 4, it is possible to obtain a tone effect in which a key-scaling process is performed on the musical tone signal or a total volume signal is added to the musical tone signal when the envelope waveform is given to the musical tone signal.

(3) In the former embodiment, the levels of the rising waveform portion and the falling waveform portion are changed linearly. However, it is possible to vary these levels with arbitrarily curved lines.

In this case, the parameter selection circuit 21 selects optimum data group from the interval data T0 to T3, the rate data R0 to R3 and the level data L0 to L3 outputted from the parameter setting circuit 6. Simultaneously, each of the rate data R0 to R3 is converted into the data of which value is changed as time elapses so as to increase or decrease the level of the envelope waveform with an arbitrarily curved line, and this data is outputted as the rate designating data RATE instead of the rate data R0 to R3.

(4) In the former embodiment, the present segment waveform is changed into the next segment waveform when detecting that the value of the envelope waveform data $D_{ENV}$ coincides with that of the level designating data LVL (as described before in the level comparator 56). However, it is possible to arbitrarily designate the waveform length (or waveform duration) of each segment waveform and measure a segment period between a segment start time and the present time, whereby it is possible to change the present segment waveform into the next segment waveform when detecting that the above segment period becomes equal to the designated waveform duration.

(5) The former embodiment is applied to an envelope waveform generating circuit which employs a method in which the rate designating data RATE is repeatedly added to the envelope waveform data so as to form the optimum envelope waveform, however, the present invention is not limited to that.

Figure 9:
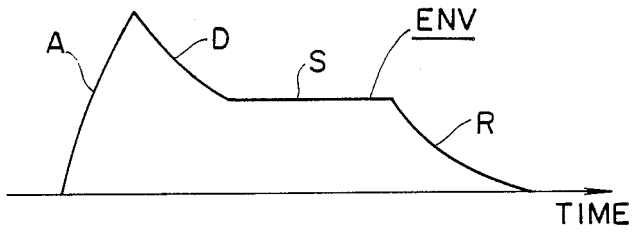
FIG. 9 shows a typical envelope waveform.

More specifically, the present invention can be applied to another envelope waveform generating circuit in which digital data group indicating sampled values of the attack portion A, the decay portion D and the release portion R within the envelope waveform ENV (shown in FIG. 9) is prestored in a memory and the digital data group is read out from the memory so as to form an optimum envelope waveform. In this case, each portion within the portions A, D and R has a segment waveform group (SEG0, SEG1, SEG2), and a read-out address counter for the memory outputs a detection signal (which corresponds to the level coincidence detection signal LEQ described in the former embodiment) when the read-out operation for each of the portions A, D and R is completed. Hence, the next segment waveform is successively designated by the above detection signal at an optimum segment changing time. The stepping operation of the address counter is prohibited from performing in a predetermined interval period (which corresponds to the period in which the level of the latch signal RCH is maintained to "1") at the segment changing time.

In the above constitution, the digital data for the attack portion A is started to be read out from the memory after the interval T0 elapses from the key-on time when the key-on signal KON is generated. Thereafter, when the last digital data for the attack portion A is read out from the memory, the stepping operation of the address counter is prohibited from being performed in the interval T1, so that the last digital data is repeatedly read out from the memory in the interval T1.

Next, when the interval T1 has been elapsed, the address counter re-starts to perform the stepping operation, so that the digital data for the decay portion D is sequentially read out from the memory. When the last digital data for the decay portion D is read out from the memory, the stepping operation of the address counter is stopped, so that this last digital data is repeatedly read out from the memory.

Thereafter, when the interval T2 has been elapsed after the key-on time, the address counter re-starts to perform the stepping operation so that the digital data for the release portion R is started to be read out from the memory.

As a result, as similar to the former embodiment, it is possible to obtain the envelope waveform in which each segment waveform is comprised by the constant waveform portion (W1) and the rising or falling waveform portion (W2).

(6) The present invention can be applied to an envelope waveform generating apparatus for employing a method in which a capacitor is charged or discharged in each segment waveform so as to form the envelope waveform. In this case, the capacitor is prohibited from being charged or discharged in a predetermined period from a segment starting time.

(7) In the present invention, the control waveform (the envelope waveform) is an arbitrary waveform. Hence, it is possible to remove the continuous portion WAV from the envelope waveform, for example. In this case, the segment waveform SEG3 is formed immediately after the segment waveform SEG2 has been completely formed in the envelope waveform ENV shown in FIG. 1(A).

(8) The former embodiment is applied to the envelope signal generating circuit of the electronic musical instrument, however, the present invention is not limited to that. Hence, it is possible to apply the present invention to the circuit for generating arbitrary control waveforms set by a player to control various characteristics of an electronic musical tone other than the amplitude envelope.

(9) In the former embodiment, the hardware logic circuits are specifically used for generating the control waveforms. However, it will be readily understood that the hardware logic circuits may be substituted by a suitable software and a microprocessor, without impairing the advantages of the present invention.

As will be understood from the foregoing description, according to the present invention, a control waveform is formed by connecting a series of segment waveforms each of which has the constant portion W1 and the rising or falling portion W2. Thus, the present invention provides a control waveform generating apparatus which can generate any desirable control waveforms with a much greater degree of freedom than the conventional apparatus.

Above is the description of the other modified embodiments. This invention may be practiced or embodied in still other ways without departing from the spirit or essential character thereof. Hence, the preferred embodiment and the other modified embodiments described herein are illustrative and not restrictive, the scope of the invention being indicated by the appended claims and all variations which come within the meaning of the claims are intended to be embraced therein.

What is claimed is:

1. A control waveform generating apparatus for an electronic musical instrument, said control waveform generating apparatus generating a control waveform which comprises a plurality of segment waveforms divided along a time axis to constitute at least a rising portion and a falling portion therein and of which level varies with a lapse of time, said control waveform generating apparatus comprising:

(a) segment designating means for sequentially designating a segment waveform among said plurality of segment waveforms in response to a command signal for generating a control waveform;

(b) control waveform means for generating each designated segment waveform as a part of said control waveform thereby to form the entire control waveform in response to the command signal;

(c) interval forming means coupled with said control waveform forming means for forming, in at least one selectable segment waveform, an interval portion of a selectable length less than the length of the selected segment waveform in which the level of said control waveform is maintained at a selectable constant level.

2. A control waveform generating apparatus according to claim 1, wherein said interval portion is formed at an initial portion in terms of time of the selected segment waveform.

3. A control waveform generating apparatus according to claim 2, wherein said constant level is a level of a last portion in terms of time of a preceding segment waveform.

4. A control waveform generating apparatus according to claim 1 further including parameter selection means for selecting parameter data group for the respective segment waveforms which includes interval data, rate data and level data therein, said interval data being supplied to said interval forming means wherein said interval period is determined by said interval data, said rate data and said level data being supplied to said control waveform forming means wherein levels of said rising portion and said falling portion are changed at a rate determined by said rate data and said constant level of the selected segment waveform is determined by said level data.

5. A control waveform generating apparatus according to claim 4, wherein said control waveform forming means outputs a level coincidence detection signal to said segment designating means when a level of said control waveform becomes equal to the level indicated by said level data, thereby causing said segment designating means to output segment selection data to said parameter selection means so that said parameter data group corresponding to a succeeding segment waveform designated by said segment selection data is outputted.

6. A control waveform generating apparatus according to claim 5, wherein said segment designating means comprises pulse generating means, segment counting means and segment change-over signal generating means therein and said command signal is a key-on signal which is generated when a key provided in a keyboard of said electronic musical instrument is depressed, said pulse generating means generating a key-on pulse or a key-off pulse based on said key-on signal, said segment counting means generating said segment selection data based on said key-on pulse, said key-off pulse and said level coincidence detection signal, a first segment waveform being selected by said segment selection data when said key-on pulse is inputted into said segment counting means, a new segment waveform next to a present segment waveform being selected by said segment selection data every time when said level coincidence detection signal is inputted into said segment counting means, a last segment waveform being selected by said segment selection data when said key-off pulse is inputted into said segment counting means, said segment change-over signal generating means generating a segment change-over signal for indicating that the present segment waveform is changed into the next segment waveform based on said segment selection data, and said interval forming means starting to maintain the last level of said present segment waveform when said segment change-over signal is inputted into said interval forming means.

7. A control waveform generating apparatus according to claim 6, wherein said interval forming means comprises latch means, interval counting means and interval comparing means therein, said segment change-over signal being latched in said latch means so as to obtain a latch signal, said latch signal being inputted into said interval counting means whereby said interval counting means starts to perform a counting operation and outputs interval count data, said interval comparing means outputting an interval coincidence detection signal when the level of said interval count data becomes equal to the level appointed by said interval data, and said interval coincidence detection signal resetting said latch means and said interval counting means.

8. A control waveform generating apparatus according to claim 7, wherein said control waveform forming means comprises sign changing means, gate means, addition means and level comparing means therein, the sign of said rate data being changed in said sign changing means by said level comparing means, said rate data becoming positive when the level indicated by said level data is larger than the level of the present control waveform, said rate data becoming negative when the level indicated by said level data is smaller than the level of said present control waveform, said level comparing means outputting said level coincidence detection signal when the level of said present control waveform becomes equal to the level indicated by said level data, said gate means being closed so that said rate data from said sign changing means is prohibited from passing through said gate means only when at least one of said latch signal and said level coincidence detection signal is inputted into said gate means, said gate means being opened so that said rate data from said sign changing means is supplied to said addition means via said gate means when none of said latch signal and said level coincidence detection signal is inputted into said gate means, said addition means adding said rate data and present control waveform data together so as to obtain addition data, and said addition data being outputted as new control waveform data.

9. A control waveform generating apparatus according to claim 1, wherein said control waveform is an envelope waveform for a musical tone signal.

10. A control waveform generating apparatus according to claim 9, wherein said segment waveforms include waveforms corresponding to an attack portion, a decay portion, a sustain portion and a release portion within said envelope waveform.

11. A control waveform generating apparatus as in claim 1 wherein the interval forming means includes means for forming an interval portion of constant level in each segment waveform of the control waveform.

* * * * *